US007621414B2

(12) United States Patent
Bederke

(10) Patent No.: US 7,621,414 B2
(45) Date of Patent: Nov. 24, 2009

(54) COUPLING PIECE FOR JOINING TWO CONTAINERS THAT ARE STACKED ONE ATOP THE OTHER, ARRANGEMENT OF STACKED CONTAINERS, AND METHOD FOR JOINING STACKED CONTAINERS USING COUPLING PIECES OF THIS TYPE

(75) Inventor: Christian Bederke, Bremen (DE)

(73) Assignee: Sec Ship's Equipment Centre Bremen GmbH, Bremen (DE)

( * ) Notice: Subject to any disclaimer, the term of this patent is extended or adjusted under 35 U.S.C. 154(b) by 716 days.

(21) Appl. No.: 10/523,500

(22) PCT Filed: Apr. 22, 2003

(86) PCT No.: PCT/EP03/04162

§ 371 (c)(1),
(2), (4) Date: Feb. 2, 2005

(87) PCT Pub. No.: WO2004/020316

PCT Pub. Date: Mar. 11, 2004

(65) Prior Publication Data

US 2005/0260054 A1 Nov. 24, 2005

(30) Foreign Application Priority Data

Aug. 24, 2002 (DE) ..... 102 38 895

(51) Int. Cl.

| | |
|---|---|
| ***B65D 88/12*** | (2006.01) |
| ***B65D 21/032*** | (2006.01) |
| *B65D 88/10* | (2006.01) |
| *B65D 21/024* | (2006.01) |

(52) U.S. Cl. ..... 220/1.5; 206/512; 220/23.4; 220/23.83; 220/23.6

(58) Field of Classification Search ..... 220/1.5, 220/23.4, 23.83, 23.6; 206/504, 509, 511, 206/512

See application file for complete search history.

(56) References Cited

U.S. PATENT DOCUMENTS 3,973,684 A 8/1976 Di Martino (Continued)

FOREIGN PATENT DOCUMENTS

| | | | |
|---|---|---|---|
| DE | 33 30 067 | A1 | 11/1984 |
| DE | 43 07 781 | A1 | 9/1993 |
| DE | 195 07 603 | A1 | 9/1996 |

(Continued)

OTHER PUBLICATIONS

Elsenführ, Speiser & Partner, 1983, *Slide-Licks, Conver.*
Robert Böck GmbH, *Dual Function Twistlock, German Lashing.*
Robert Böck GmbH, *Fulley Automatic Lock T-4, German Lashing.*
MacGregor Prospectus, "AFC-1 Fixing Cone", Mar. 1998.

*Primary Examiner*—Anthony D Stashick
*Assistant Examiner*—Niki M Eloshway
(74) *Attorney, Agent, or Firm*—McGlew and Tuttle, P.C.

(57) ABSTRACT

A coupling piece for joining two containers (35, 36) that are stacked one atop the other, particularly onboard ships is provided. Such a coupling is provided at corner fittings (43, 44) and each include a stop plate (21) and a coupling projection (22, 23) on each side of the stop plate (21). A first coupling projection (22) can be placed on the corner fitting of one container (36) and the other coupling projection (23) is provided with a locking catch (28, 46, 54) for locking inside a corner fitting of the other container (35). The drawback that front-side openings in upper corner fittings (43, 44) of a container (36) are obstructed by a locking catch of the coupling piece, hindering the use of lashing means is overcome with the coupling piece locking catch (28, 46, 54), when viewed in the longitudinal direction of the containers (35, 36), being arranged laterally on the other coupling projection (23).

9 Claims, 6 Drawing Sheets

U.S. PATENT DOCUMENTS

| | | | | |
|---|---|---|---|---|
| 4,564,984 | A | 1/1986 | Takaguchi | |
| 4,942,975 | A * | 7/1990 | Capron et al. | 220/23.4 |
| 5,560,088 | A | 10/1996 | Nitsche et al. | |
| 6,334,241 | B1 | 1/2002 | Flodin | |
| 6,363,586 | B1 * | 4/2002 | Neufingerl | 24/287 |
| 6,490,766 | B1 | 12/2002 | Tiemann | |
| 6,533,511 | B1 | 3/2003 | deKoning | |
| 7,231,695 | B2 * | 6/2007 | Park | 24/287 |
| 2003/0006233 | A1 * | 1/2003 | Reynard | 220/23.4 |
| 2003/0164375 | A1 | 9/2003 | Neufingerl | |

FOREIGN PATENT DOCUMENTS

| | | | |
|---|---|---|---|
| DE | 195 07 603 | C2 | 9/1996 |
| DE | 296 17 029 | U1 | 1/1997 |
| DE | 298 11 460 | U1 | 10/1998 |
| DE | 100 04 359 | A1 | 8/2001 |
| DE | 100 23 436 | A1 | 11/2001 |
| DE | 101 05 785 | A1 | 8/2002 |
| JP | 5-16991 | | 1/1993 |
| WO | WO 01/76980 | A1 | 10/2001 |
| WO | WO 03/053736 | A1 | 7/2003 |

* cited by examiner

COUPLING PIECE FOR JOINING TWO CONTAINERS THAT ARE STACKED ONE ATOP THE OTHER, ARRANGEMENT OF STACKED CONTAINERS, AND METHOD FOR JOINING STACKED CONTAINERS USING COUPLING PIECES OF THIS TYPE

CROSS REFERENCE TO RELATED APPLICATIONS

This application is a United States National Phase application of International Application PCT/EP2003/004162 and claims the benefit of priority under 35 U.S.C. § 119 of German Application DE 102 38 895.4 filed Aug. 24, 2002, the entire contents of which are incorporated herein by reference.

FIELD OF THE INVENTION

The present invention pertains to a coupling piece for joining two containers that are stacked one atop the other, particularly onboard ships, at their corner fittings, comprising a stop plate and a coupling projection on each side of the stop plate, of which the first coupling projection can be placed on the corner fitting of one container and the other coupling projection is provided with a locking catch for locking inside a corner fitting of the other container. Furthermore, the present invention pertains to an arrangement of containers that are stacked one atop the other, and to a method for joining containers that are stacked one atop the other with coupling pieces of this type.

BACKGROUND OF THE INVENTION

Such a coupling piece is known, e.g., from DE 298 11 460 U1. This coupling piece is a so-called midlock, which is used for lashing containers as deck cargo onboard ships, especially for joining two containers stacked one atop the other. The midlock is used whenever two 20-foot containers are placed on a space for a 40-foot container, namely at the container corner fittings on the front sides, facing one another, of the 20-foot containers, standing one behind the other. In fact, only a very narrow gap of about 76 mm is produced between the 20-foot containers standing one behind the other, such that the corner fittings arranged on these sides and therefore the midlock as well are poorly accessible for stevedores. The corner fittings are freely accessible on the other, free front sides. So-called twistlocks are generally used here, which are opened manually by the stevedore when unloading the container. The container is then raised, whereby the midlocks slide out of the corner fittings of the lower container because of the inclined standing of the container.

During the loading of the container, the midlocks are first suspended in the lower corner fitting of the upper container with the containers hovering over land. To this end, in older variants, hook-type catches were used on a front side (the side pointing in the longitudinal direction of the container to the front side of same) of the upper coupling projection. More contemporary variants, such as, for example, the midlock also illustrated in DE 298 11 460 U1, have lateral projections on the upper coupling projection that extend approximately in parallel to the stop plate. These projections grip into the lower corner fitting of the upper container. The opposite, lower coupling projection has a locking catch on a front side. When the upper container is placed on the lower container which is already located onboard the ship, either the entire midlock then slides against the upper container or the entire upper container slides forwards or backwards on a lower inclined surface of the locking catch and catches in the upper corner fitting of the lower container during the further lowering of the container.

This midlock has the following drawback. Usually onboard ships, the rear container corner fitting, into which a midlock is usually inserted, is poorly accessible, as explained above. However, there are also container ships, in which the containers are still accessible at least at some of the loading spaces, or because not all loading spaces are occupied, for attaching additional lashing means, for example, lock rods. However, in the prior-art midlocks, lashing means cannot be fastened in the upper corner fitting of the lower container, since the front-side opening is occupied because of the locking catch engaging therein. For this reason, a special hook fitting of a lock rod is suggested in DE 100 04 359 A1, which grips around the locking catch of conventional midlocks. Up to now, this hook fitting has not been used in practice.

SUMMARY OF THE INVENTION

Based on the above, the basic object of the present invention is to create a coupling piece as well as an arrangement of containers stacked one atop the other and a method for joining containers stacked one atop the other, in which the front-side opening of the upper corner fitting of a container remains free for lashing means.

To accomplish this object, the coupling piece according to the present invention is characterized in that the locking catch, viewed in the longitudinal direction of the container, is arranged laterally on the other coupling projection. The arrangement according to the present invention is characterized in that the containers are joined with one another at least at the corner fittings of a front side of the container with the coupling piece according to the present invention each. According to the method according to the present invention, the upper container is swung horizontally about its vertical axis, or, as an alternative, is offset laterally when coupling and/or uncoupling with the lower container.

Because of the lateral arrangement of the locking catch, the front-side bore hole of the corner fitting of the lower container remains freely accessible for lashing means. The locking catch is assigned to a lateral opening of the corner fitting which is not usually used for lashing containers onboard ships anyway, where it therefore also does not lead to interference.

However, the measure according to the present invention offers another advantage. As is explained above, 20-foot containers are joined with one another on loading spaces for 40-foot containers by means of two different fittings by stacking one atop the other, and especially with two midlocks, on the one hand, and with two twistlocks, on the other hand. Thus, different fittings must be provided onboard the ship. Moreover, a twistlock that is inadvertently used instead of a midlock can often be removed only with difficulty. Therefore, efforts have been made in the past to create a universally insertable fitting, a so-called universal lock (also called unilock), which can be universally inserted at all positions. An example of the universal lock of this type is the subject of DE 101 05 785 A1. The universal locks proposed until now have not yet found a good footing in practice. Furthermore, they have the drawback that, when unloading the container, the stevedore must always still manually open the universal lock at the accessible container corner fittings ("twistlock position"), so that it is unlocked with the upper corner fitting of the lower container.

In order to prevent this and to create a coupling piece that can be unlocked without the involvement of stevedores, so-called fully automatic devices were proposed in DE 43 07 781

A1 and in WO 01/76980 A1, in which movable locking elements are provided. These locking elements move as a result of movements of the ship, particularly rolling movements, during travel and thereby lock the coupling piece with the upper corner fitting of the lower container. In WO 01/76980 A1, a ball movable in a cage is provided as the locking element. In DE 43 07 781 A1, it is suggested to use a pivotable block, which pivots from one side to the other depending on the position of the ship, and thus interlocks under the elongated hole of the upper corner fitting of the lower container. In this case, the locking elements are provided such that, when the ship is at rest, i.e., in the harbor, they automatically reach a rest position, in which they unlock the coupling piece with the upper corner fitting of the lower container, so that the upper container can be unloaded.

However, the drawback of these fully automatic devices is that the movable locking elements are very susceptible, in particular, to dirt. Therefore, these fully automatic devices are very trouble-prone even with good maintenance.

A coupling piece equipped with the features according to the present invention can also be used as a fully automatic device. A coupling piece each is inserted into all four lower corner fittings of the upper container. Using four coupling pieces of the same design automatically results in the locking catches pointing in different directions on the "front" corner fittings, on the one hand, and the "rear" corner fittings, on the other hand. When placing the thus prepared container on the lower container, the container rotates easily about its vertical axis, in particular because of the shape of the coupling pieces, and the lower coupling projections of the coupling pieces lock with the locking catches into the corner fittings of the lower container. This results in a secure locking of the containers stacked one atop the other during movements of the ship. Because of rolling movements of the ship in its travel, the containers tilt in the transverse direction. As a result, one long side of the container is under pressure load, while the opposite long side is under tension load. The coupling pieces on the pressure side of the container prevent the shifting of the entire container, such that the locking catch on the tension side cannot disengage from the upper corner fitting of the lower container and thus reliably transfers the tensile forces between the upper and lower containers on the tension side. Containers stacked in the bow section of a ship, in which the case may arise that tensile loads occur on all four coupling pieces because of nosing of the ship under circumstances, are also held securely. Because of the mass moment of inertia of the respective upper container, this will not by itself rotate against the respective lower container, so that a secure locking is also given under these circumstances.

According to a design embodiment of the present invention, the length of the other (lower) coupling projection is slightly shorter than the length of an associated elongated hole of the associated corner fitting of the other (lower) container. Correspondingly, the maximum width of the locking catch should also be slightly less than the width of the elongated hole. The lower coupling projection thus just passes through the elongated hole, which is completely sufficient for the desired coupling and uncoupling of the containers stacked one atop the other; it opposes an undesired uncoupling because of movements of the ship, however. This is further supported if leading edges of the other (lower) coupling projection have a contour that corresponds to the contour of the assigned elongated hole in this area. Consequently, the coupling piece has only a very small play in the longitudinal direction, so that the coupling piece is also blocked in the transverse direction. There is thus further improved securing against shifting of the coupling piece in the transverse direction, so that the secure joining of the containers stacked one atop the other is further improved by means of the locking catch.

According to another design embodiment of the present invention, a lead-in taper is arranged under the locking catch for the facilitated introduction of the lower coupling projection into the associated elongated hole at the container corner fitting. This lead-in taper tapers downwards, so that it brings about coupling for the correct positioning of the lower coupling projection, and thus of the entire coupling piece.

At the junction between the stop plate and the lower coupling projection, a lead-in chamfer should be arranged on the long side of the lower coupling projection facing away from the locking catch. After the coupling piece has been correctly positioned by the lead-in taper for insertion into the elongated hole, the lead-in chamfer is now used by the further lowering of the upper container. By means of the lead-in chamfer, the coupling piece is pushed, especially by means of further lowering of the upper container, in the direction in which the locking catch points and consequently brings about the coupling of the upper container with the lower container (locking position). Furthermore, the coupling piece has only a little play in the transverse direction of the container because of the lead-in chamfer, so that the locking catch always reliably undercuts the elongated hole of the upper corner fitting of the lower container. Thus, a further improvement is provided in the secure binding of the containers stacked one atop the other.

The lead-in chamfer has an angle corresponding to a chamfer at the upper elongated hole of the upper container corner fitting and thus fits tightly in the elongated hole. As an alternative, only the upper area pointing to the stop plate corresponding to the length of the chamfer at the elongated hole may be provided with an angle corresponding to the chamfer at the elongated hole. A flatter curve as compared with this chamfer is then provided under this chamfer. Consequently, the vertical distance between the locking catch and the stop plate can be reduced, as a result of which the vertical play of the coupling piece in the corner fitting is also simultaneously reduced. Consequently, the certainty of lashing the containers joined with one another onboard the ship is further increased.

To make the uncoupling easier, a sloping shoulder may be arranged on the top side of the locking catch. This variant, in particular, especially suitable for fully automatic devices. However, as an alternative, the top side may also have a horizontal top side. In order to make the uncoupling easier then, the locking catch should be provided with a side wall directed sloping inwardly. This variant is particularly suitable for midlocks and may be used in addition or as an alternative to the sloping shoulder on the top side of the locking catch.

According to an alternative exemplary embodiment of the coupling piece according to the present invention, the locking catch is designed such that it is cross-slidable in relation to the lower coupling projection. When the lower coupling projection is inserted into the upper elongated hole of the upper corner fitting of the container, the locking catch is pushed back against the lower coupling projection and then, after insertion in the elongated hole, is pushed back again into the locking position by means of the force of a spring. This variant is advantageous with containers very close to one another onboard, since the containers now no longer have to be rotated about their vertical axis during loading because of the "alternative" locking catch.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

BRIEF DESCRIPTION OF THE DRAWINGS

The present invention is explained in detail below based on exemplary embodiments shown in the drawings, in which.

DESCRIPTION OF THE PREFERRED EMBODIMENTS

Figure 2:
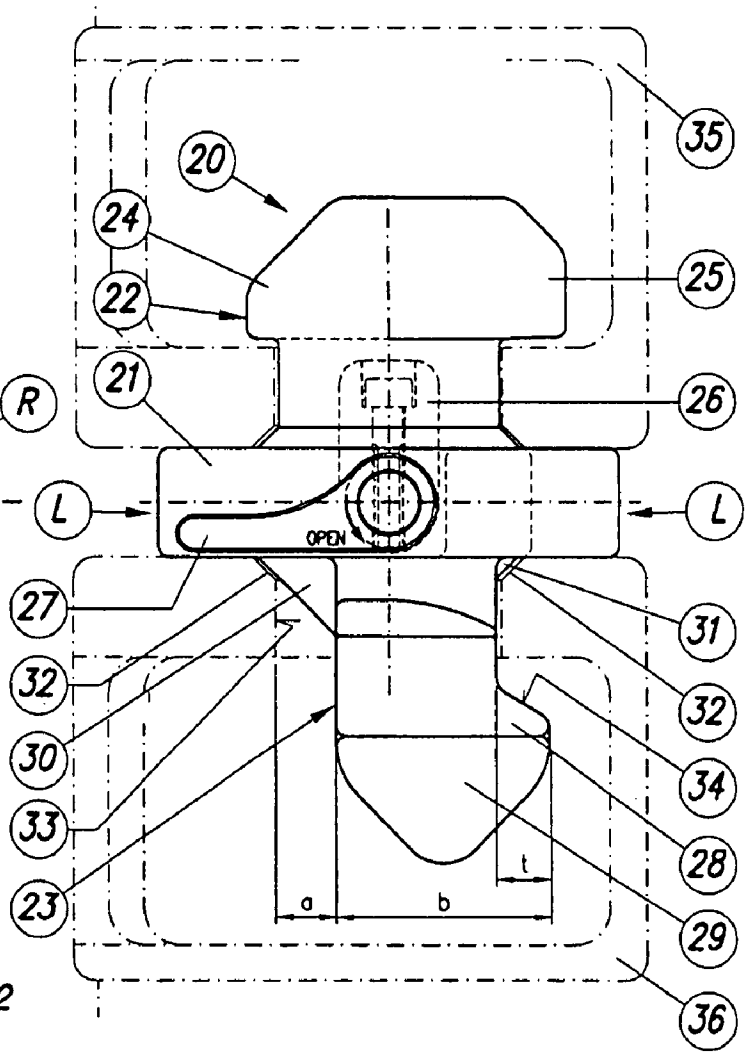
FIG. 2 is a front view of the coupling piece according to FIG. 1.

Referring to the drawings in particular, the embodiments of a coupling piece according to the present invention shown in FIGS. 1 through 8 are particularly suitable as so-called fully automatic devices 20, also designated as unilocks. The fully automatic device 20 comprises a central stop plate 21 and coupling projections 22 and 23 extending upwards and downwards therefrom. On the upper coupling projection 22 are arranged lateral projections 24, 25, which grip behind a lower elongated hole of a container corner fitting, so that they are interlocked within this corner fitting. A locking piece 26, which can be pivoted to the side into the plane of the stop plate 21 by means of a hand lever 27, is used to lock and unlock the upper coupling projection 22 in this container corner fitting. To this extent, the present fully automatic device 20 still corresponds to a conventional midlock, as is shown, for example, in DE 298 11 460 U1, and, like this midlock, is inserted into the lower corner fitting of the upper container by the stevedore.

Since the upper elongated holes on the upper corner fittings are always directed in the longitudinal direction of the container just as the lower elongated holes of the lower corner fittings in standard containers, the hand levers 27 are always turned toward the container front side (the front provided with doors or the closed back). Therefore, within the framework of this specification and the claims the side of the hand lever 27 is designated as the front V, the opposite side is designated as the back R and the sides adjacent hereto, pointing from the front V to the back R, are designated as the long sides L.

Figure 1:
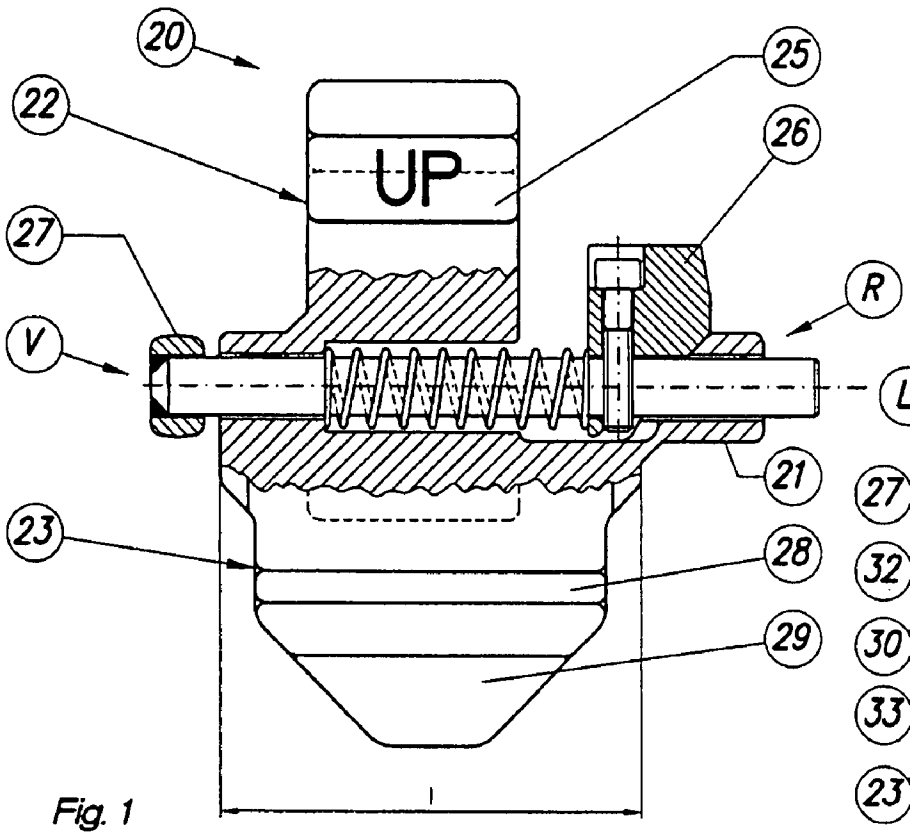
FIG. 1 is a partially cutaway, side view of a coupling piece having the features of the present invention.

The lower coupling projection 23 is designed in a special manner. This coupling projection 23 has a projecting locking catch 28. As can be seen in FIGS. 1 and 2, the locking catch 28 is assigned to one of the two long sides L, especially the right-hand long side L according to the view in FIG. 2. The locking catch 28 is arranged laterally, so that an opening of the container corner fitting assigned to the front sides of the container remains free for hooking in lashing means.

Under the said locking catch 28, the coupling projection 23 is provided with a downwardly directed lead-in taper 29. At the junction from the lower coupling projection 23 to the stop plate 21, a lead-in chamfer 30 is provided on the long side L of the lower coupling projection 23 facing away from the locking catch 28. The lead-in chamfer 30 causes the respective fully automatic device 20 to shift to the right in the view according to FIG. 2 when the fully automatic device 20 is inserted into the upper corner fitting of the lower container, i.e., when the upper container is placed on the lower container.

On the side of the lower coupling projection 23 opposite the lead-in chamfer 30, a chamfer 31 is provided at the junction between the coupling projection 23 and the stop plate 21. This chamfer is primarily provided for reasons of stability. However, as can be seen in FIG. 2, the chamfer 31, as well as the upper part of the lead-in chamfer 30, correspond exactly to a chamfer 32 at the elongated hole 33 of the corner fitting.

The length 1 of the lower coupling projection 23 is only slightly less than the length of the elongated hole 33. The width b of the locking catch 28 at its widest point is likewise only slightly less than the width of the elongated hole 33. The projecting depth t of the locking catch 28 is thus only slightly less than the distance a of the side surface of the coupling projection 28 facing away from the locking catch 28 from the associated inside wall of the elongated hole 33 (FIG. 2).

To make unlocking easier, the locking catch 28 is provided with an outwardly sloping shoulder 34. When the upper container and thus the fully automatic device 20 are raised, the shoulder 34 abuts against the bottom of the container corner fitting, so that the fully automatic device 20 is pressed to the left in the view according to FIG. 2 and is thus disengaged from the elongated hole 33.

Figure 3:
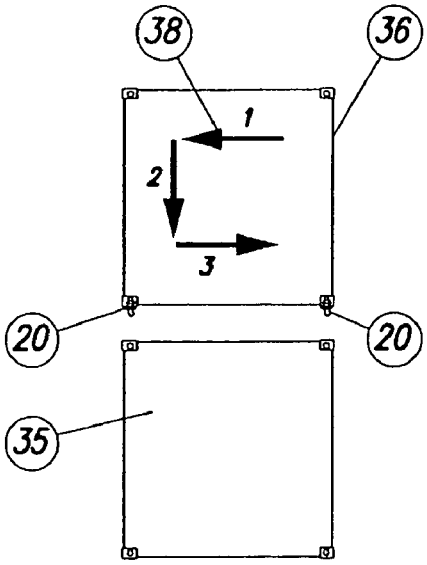
FIG. 3 is a schematic view of two containers during the loading of same, shortly before locking.
Figure 6:
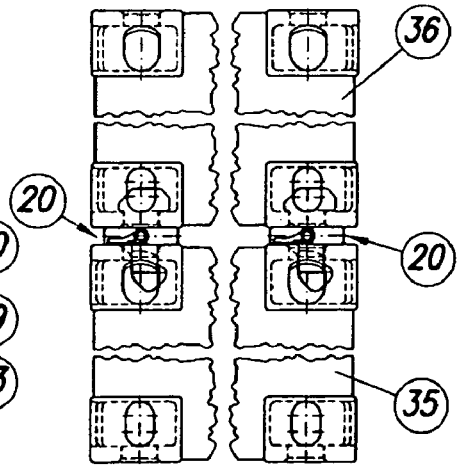
FIG. 6 is a detail of the containers stacked one atop the other in the locked state.
Figure 7:
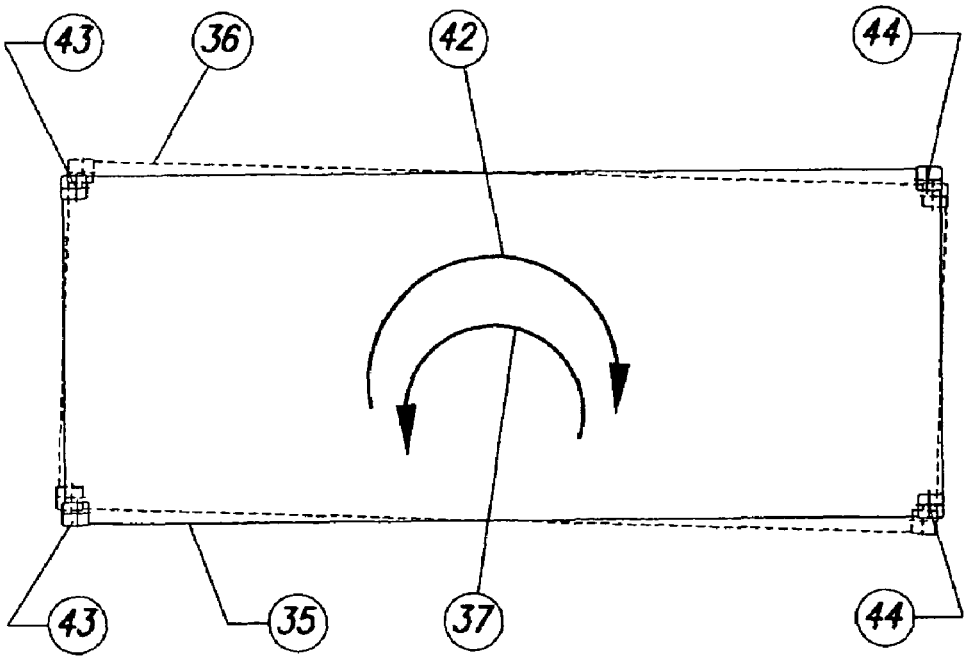
FIG. 7 is a schematic top view of two containers during locking and unlocking.

FIGS. 3 through 8 show the loading and unloading of containers using the fully automatic device 20. FIG. 3 shows a container 35 already parked, e.g., onboard ships, onto which another container 36 shall be placed. The other container 36 is shown in the position shortly before the locking on the lower container 35. As can be recognized in FIG. 5, the fully automatic device 20 sets down on the, upper edge of the elongated hole 33 with the lead-in taper 29 and it is then locked by means of a movement of the entire upper container 36 by means of a longitudinal rotation of the container 36 about its vertical axis (see FIG. 7, arrow 37). The sequence of movements of the fully automatic device is illustrated by the combination of arrows 38 in FIGS. 4 and 5. The front fully automatic devices 20 first slide to the left (arrow 38.1) during the locking because of the lead-in taper 29, while the rear fully automatic devices 20 slide to the right. By means of further lowering of the upper container 36, the fully automatic device 20 falls vertically at first (arrow 38.2). By means of even further lowering of the upper container 36, the front fully automatic devices 20 finally slide to the right (arrow 38.3), while the rear fully automatic devices 20 analogously slide to the left into their respective locking position. FIG. 6 shows the containers 35, 36 finally in the completely locked position.

Figure 4:
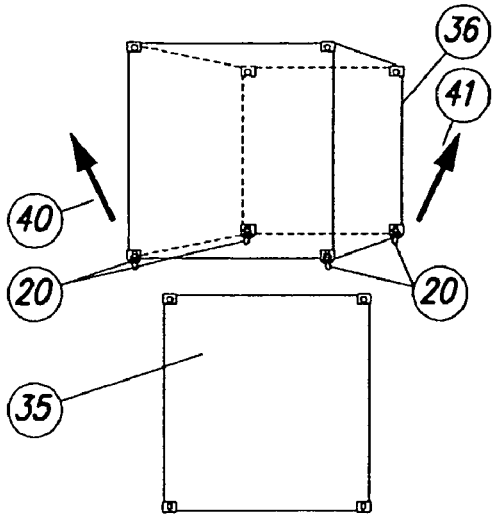
FIG. 4 is a schematic view of the containers during unloading shortly after unlocking.
Figure 5:
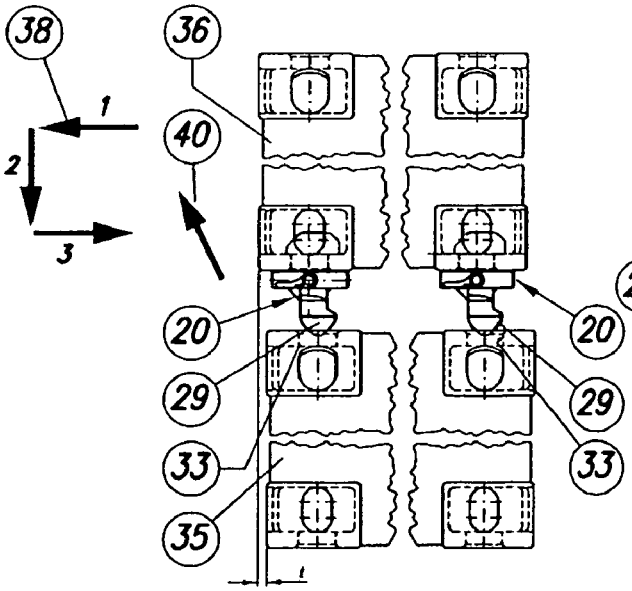
FIG. 5 is a detail of the containers during the loading and unloading of the containers.

Analogously to FIG. 3, FIG. 4 shows the upper container 36 shortly after unlocking during the unloading of the container 36. The container [36] is in turn rotated slightly about its vertical axis in relation to the lower container 35. The front fully automatic devices 20 slide upwards to the left corresponding to arrow 40 in the view according to FIG. 4 and FIG. 5 out of the elongated holes 33, while the rear fully automatic devices 20 slide out of the elongated holes 33 upwards to the right according to arrow 41 in FIG. 4. The container 36 thus rotates clockwise according to arrow 42 in FIG. 7 during unloading. These directions according to the arrows 38, 40, 41, 42 arise, since the fully automatic devices 20 assigned to the front corner fittings 44 of the containers 35, 36, on the one hand, and the locking catches 28 of the fully automatic devices 20 assigned to the rear corner fittings 43, on the other hand, point in opposite directions with their locking catches 28.

Figure 8:
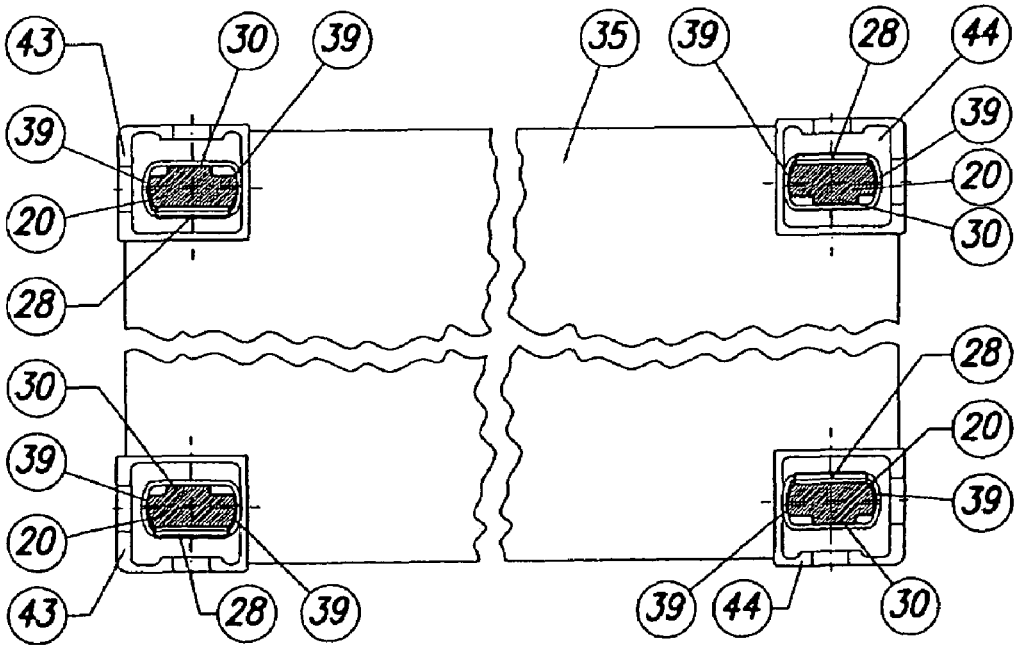
FIG. 8 is a schematic top view of the lower container in the locked state.

It can be easily seen in FIG. 8 that front and rear leading edges 39 of the fully automatic device, more exactly of the lower coupling projection 23, have a contour at least in the area of the elongated hole 33 of the upper corner fitting 43, 44 of the lower container 35 that corresponds to the contour of the elongated hole 33. Concretely, an arc-shaped contour is provided.

If the fully automatic devices 20 assigned to the rear corner fittings 43 or the ones assigned to the front corner fittings 44 are inadvertently inserted the wrong way around, this is also not the end of the world. The container 36 is then lowered and raised entirely offset laterally during the locking and unlocking. However, such a situation should be avoided by the careful work of the stevedore. If only one of the fully automatic devices is inserted the wrong way around, such that the locking catches 28 assigned to the front corner fittings 44 and to the rear corner fittings 43 point towards one another or point away from one another, the container cannot be locked at all. The stevedore notices this, so that the container can be raised again and the mistake can then be corrected. At any rate, a situation, in which the fully automatic device locks and then unlocks only with great difficulty and thus the container cannot be unloaded, cannot occur.

Figure 10:
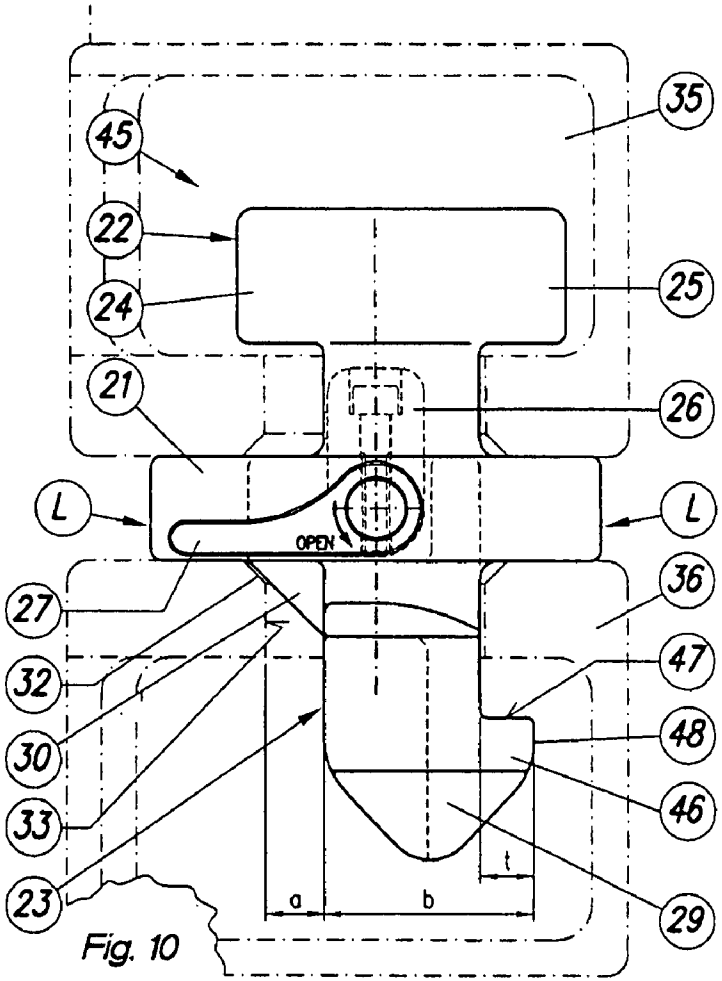
FIG. 10 is a front view of the coupling piece according to FIG. 9.
Figure 9:
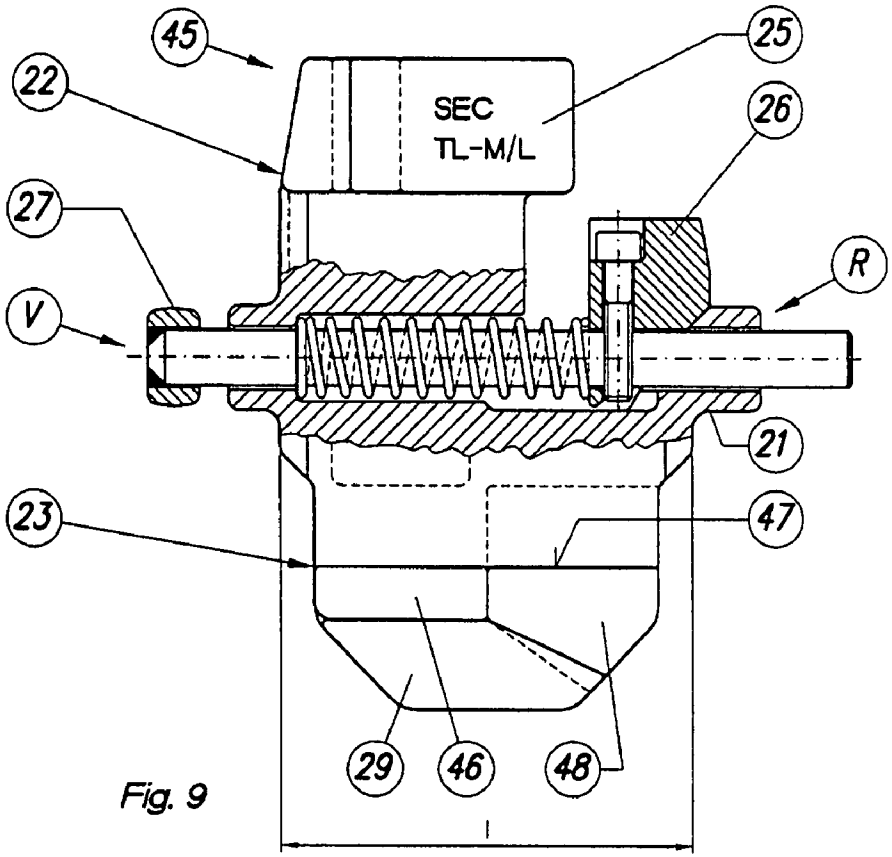
FIG. 9 is a partially cutaway, side view of a second exemplary embodiment of a coupling piece having the features of the present invention.
Figure 11:
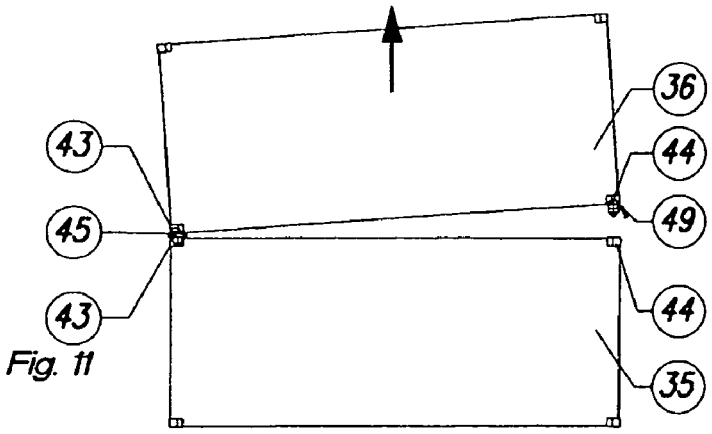
FIG. 11 is two containers stacked one atop the other with a coupling piece according to FIG. 9 when unloading shortly before unlocking.
Figure 12:
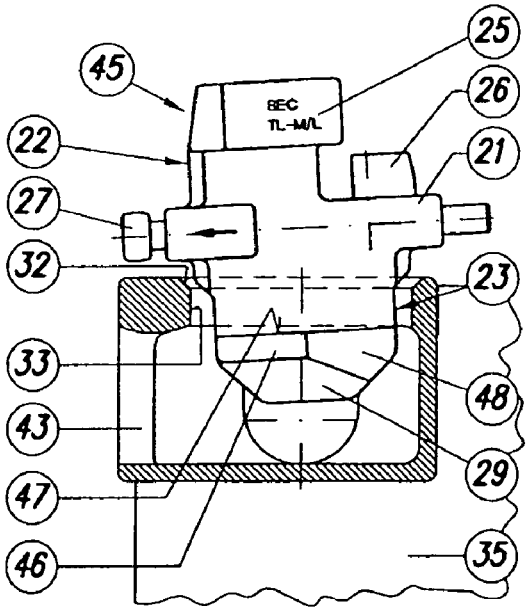
FIG. 12 is a side view of a detail of the containers according to FIG. 11 shortly before unlocking.
Figure 13:
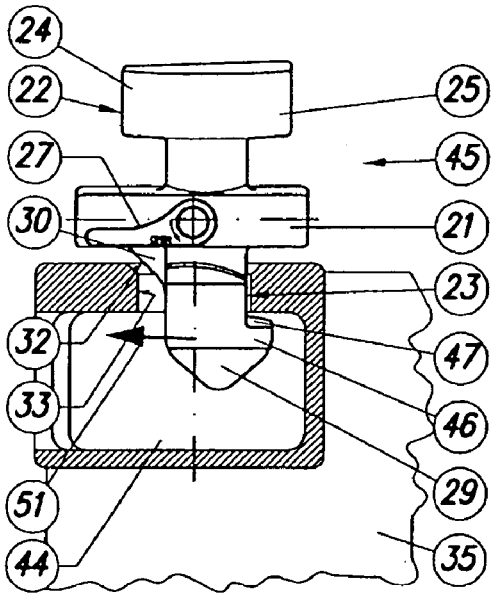
FIG. 13 is a front view of the detail of the container according to FIG. 12.
Figure 14:
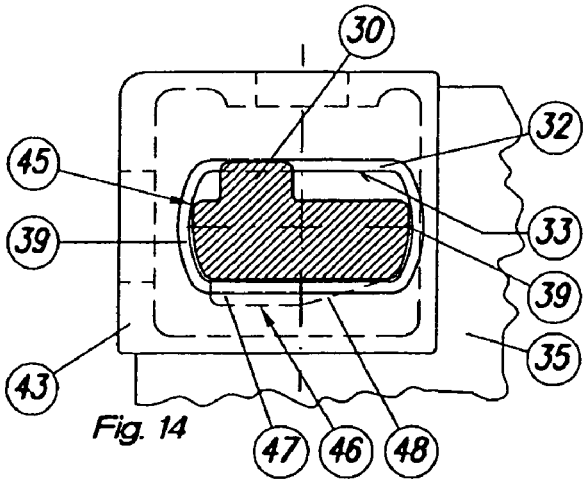
FIG. 14 is a top view of the detail of the container according to FIG. 12.

A coupling piece that is particularly suitable as a midlock 45 is shown in FIGS. 9 through 14. The midlock 45, in its essential components, corresponds to the fully automatic device 20 according to FIGS. 1 through 8, so that comparable components in FIGS. 9 through 14 are designated with the same reference numbers as in FIGS. 1 through 8. However, as can be seen in FIG. 10, a locking catch 46 of the midlock 45, which is likewise arranged laterally, does not have a sloping shoulder, but rather has a somewhat horizontal top side 47. An outer side wall 48 of the locking catch 46 is guided sloping inwardly on the side facing away from the hand lever 27, as this can be particularly easily seen in FIG. 14.

The unlocking of the upper container 36 from the lower container 35 is shown in FIGS. 11 through 14. First, on the front corner fittings 44 that are freely accessible to the stevedore, a semiautomatic twistlock 49 inserted there is manually unlocked by the stevedore. Then, the container 36 is raised with a container loading crane (arrow 50). The front corner fittings 44 of the containers 35, 36 lift off from one another and the container 36 tilts. Consequently, the midlock 45 also tilts, as can be easily seen particularly in FIG. 12. Because of the sloping side wall 48, the midlock 45 is now pressed to the left in the view according to FIG. 13 (arrow 51), as a result of which the locking catch 46 is released from the elongated hole 33.

The locking of the container 36 and of the midlock 45 during the loading of the container 36, i.e., when same is placed on the lower container 35, is performed analogously to the fully automatic device 20 explained based on FIGS. 1 through 8.

Figure 15:
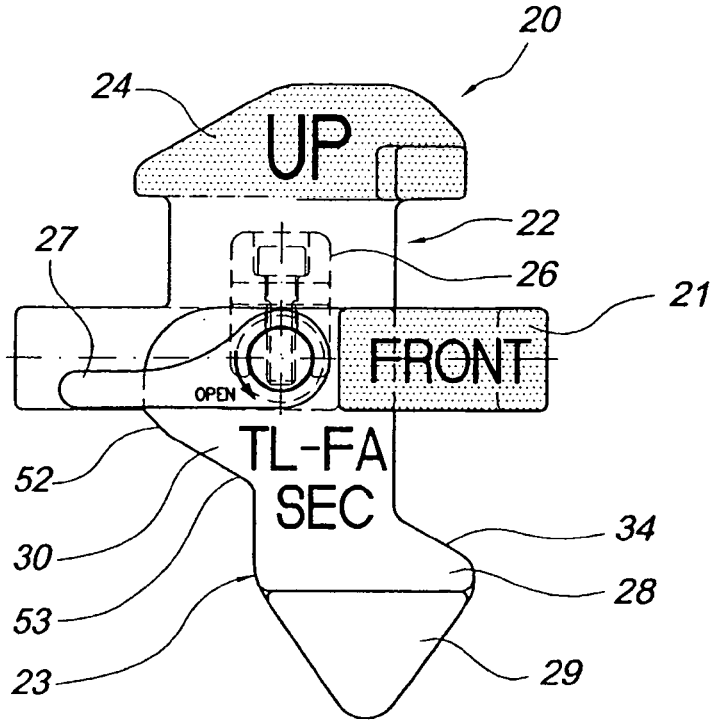
FIG. 15 is, a front view of a third exemplary embodiment of a coupling piece having the features of the present invention.

FIG. 15 shows an exemplary embodiment, in which the lead-in chamfer is first provided with a steeper chamfer 52. The angle of this chamfer (52) corresponds to the angle of the chamfer 32 at the elongated hole 33 of the container corner fitting. Under this chamfer 52, the lead-in chamfer 30 passes over into a chamfer 53 with an angle that is flatter compared to the chamfer 52. This variant has the advantage that the vertical distance between the bottom of the stop plate 21 and the upper shoulder 34 on the locking catch 28 can be shortened. This also results in a smaller vertical play of the coupling piece. The containers thus joined with one another for safety are thus improved.

Figure 16:
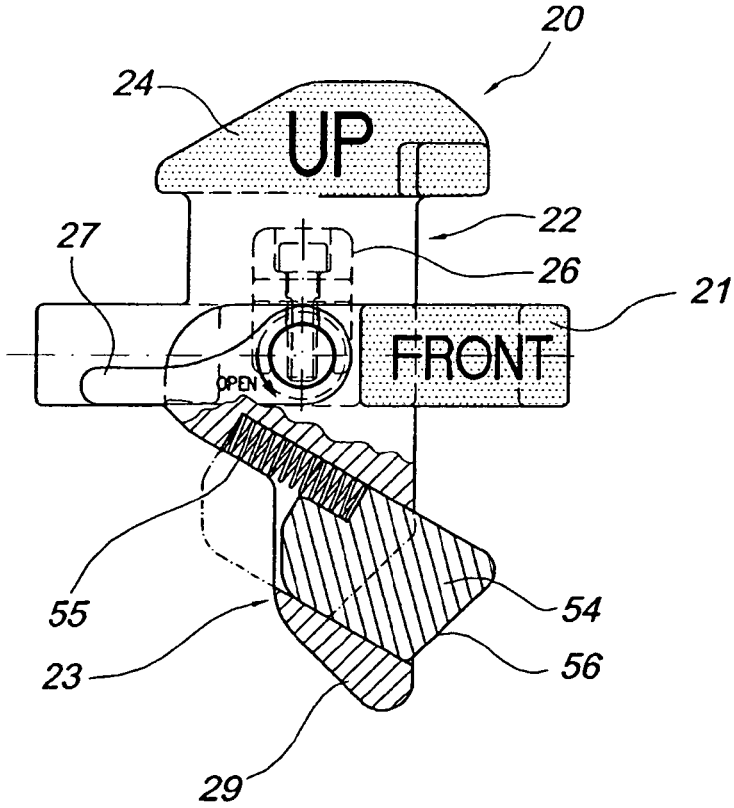
FIG. 16 is a front view of another exemplary embodiment of a coupling piece having the features of the present invention.

In the exemplary embodiment shown in FIG. 16 the locking catch 54 is displaceable against the lower coupling projection 23. Concretely, the locking catch 54 can be moved slightly sloping upwards in the direction of the lead-in chamfer 30. This variant is advantageous if the containers stacked one atop the other are so close to one another onboard ships that they cannot be rotated about their vertical axis for the joining and/or separating of the containers during the loading and/or unloading of the containers. When the upper container 36 is placed on the lower container 35, as before, the lead-in taper 29 on the lower coupling projection 23 is first inserted into the elongated hole 33. Then, a lower slope sets down on the chamfer 32 at the elongated hole 33. As a result of this, the locking catch 54 is pressed backwards against the force of a spring 55 and comes into the position shown by broken lines in FIG. 16. The lower coupling projection 23 can now slide into the elongated hole 33. The locking catch 54 is then pushed back again by means of the force of the spring 55 into the starting position. The coupling piece is locked.

In the coupling piece shown in FIG. 16, the locking catch 54 is concretely pushed back into the elongated hole 33 only during the loading of the container, i.e., during the insertion of the lower coupling projection 23 into the elongated hole 33. Because of the upwardly sloping course of the direction of displacement of the locking catch, which corresponds approximately to the angle of the upper shoulder 34, a force directed almost at right angles to the moving direction of the locking catch 54 occurs on the locking catch 54 during the unloading. Thus, the containers must be rotated slightly during unloading. However, it is guaranteed by this measure that the containers stacked one atop the other do not independently unlock due to forces acting on them while at sea. Difficulties possibly occurring during the unloading of the container because of containers standing close to one another take second place to safety during the transport onboard ships. At the same time, it can be seen that the course of the lower slope 56 compared to the direction of displacement of the locking catch 54 is slightly greater than a right angle. Consequently, an optimal force on the locking catch 54 is reached for pushing back during the loading.

While specific embodiments of the invention have been shown and described in detail to illustrate the application of the principles of the invention, it will be understood that the invention may be embodied otherwise without departing from such principles.

The invention claimed is:

1. A method for joining said containers stacked one atop the other, the method comprising:

providing containers with coupling pieces at corner fittings, each of the coupling pieces comprising a stop plate and a first side coupling projection on a first side of the stop plate and a second side coupling projection on a second side of the stop plate, the first side coupling projection being placed on the corner fitting of one of the containers and the second side coupling projection being provided with a locking catch for locking inside a corner fitting of the other of the containers, the locking catch being arranged laterally on the second coupling projection and the locking catch having a sloping shoulder on a stop plate side of the locking catch; and moving the upper container relative to the lower container to provide an automatic coupling and/or uncoupling with the lower container.

2. A method in accordance with claim 1, wherein the upper container is rotated about its vertical axis during the coupling and/or uncoupling by means of the shape of the second side coupling projection generating a lateral force upon lifting the upper container, the shape including the sloping shoulder of the coupling pieces and the sloping shoulder sliding on a surface of the respective corner piece with locking catches at one end of the container directed in one lateral direction and with locking catches at another end of the container directed in another lateral direction.

3. A method for joining said containers according to claim 1, wherein plural containers are stacked one atop the other onboard ships, with said coupling pieces wherein said upper container is one of:

offset laterally during the coupling and/or uncoupling with the lower container; and rotated about its vertical axis during the coupling and/or uncoupling with the lower container.

4. A method in accordance with claim 1, wherein said upper container is offset laterally during the coupling and/or uncoupling due to the shape of said coupling pieces.

5. A coupling piece arrangement for joining two containers, that are stacked one on top of the other, the coupling arrangement comprising:

a lower container corner fitting having a normally horizontal upper surface, corresponding to a normally horizontal upper surface of the lower container of the two containers, said corner fitting having a chamfered opening leading to a normally vertical elongate hole with a catch receiving surface leading to a laterally expanded lower hole portion; and a coupling piece with a stop plate and an upper container coupling projection on an upper side of said stop plate for placement in a corner fitting of an upper container and a lower coupling projection on a lower side of said stop plate for placement in said lower container corner fitting, said lower coupling projection comprising a non-positive locking means including a locking catch extending laterally with respect to a longitudinal direction of the containers and having a friction engagement surface for engaging said catch receiving surface inside said lower container corner fitting, said non-positive locking means for guiding said coupling piece during insertion into said lower container corner fitting with a guided lateral movement of said lower coupling projection away from said catch receiving surface, with a subsequent guided downward movement of said lower coupling projection into said laterally expanded lower hole portion and with a following subsequent guided lateral movement of said lower coupling projection toward said catch receiving surface to bring said friction engagement surface into contact with said catch receiving surface to provide frictional locking of said coupling piece in said lower container corner fitting against torsional forces and for allowing removal of said coupling piece from said lower container corner fitting by guiding said coupling piece away from said catch receiving surface upon applying upward force on said coupling piece.

6. A coupling piece in accordance with claim 5, wherein said non-positive locking means includes a catch surface of said locking catch with a sloping shoulder defining said friction engagement surface and with a forward end with a lead-in taper to impart said guided lateral movement during insertion and with said lower coupling projection having a lead-in chamfer adjacent to said stop plate and extending laterally with respect to the longitudinal direction of the containers in a direction opposite to said locking catch to impart said following subsequent guided lateral movement of said lower coupling projection toward said catch receiving surface during insertion and said sloping shoulder guiding said coupling piece away from said catch receiving surface upon applying upward force on said coupling piece.

7. An arrangement of containers stacked one atop the other onboard ships, the arrangement comprising:

an upper container with an upper container first corner fitting at a normally horizontal lower surface, with an upper container second corner fitting at the lower surface, with an upper container third corner fitting at the lower surface, and with an upper container fourth corner fitting at the lower surface;

a lower container with a lower container first corner fitting at a normally horizontal upper surface, with a lower container second corner fitting at the upper surface, with a lower container third corner fitting at the upper surface, and with a lower container fourth corner fitting at the upper surface, each of said lower container corner fittings comprising a normally horizontal fitting upper surface, corresponding to the upper surface of the lower container, with an opening leading to a normally vertical elongate hole with a catch receiving surface adjacent to a laterally expanded lower hole portion;

a first coupling piece with a first piece stop plate and a first piece upper container coupling projection on an upper side of said first piece stop plate for placement in said upper container first corner fitting and with a first piece lower coupling projection on a lower side of said first piece stop plate for placement in said lower container first corner fitting, said first piece lower coupling projection comprising a first piece non-positive locking means including a first piece locking catch extending laterally with respect to a longitudinal direction of the containers and having a first piece friction engagement surface for engaging said catch receiving surface inside said lower container first corner fitting, said first piece non-positive locking means for guiding said first coupling piece during insertion into said lower container first corner fitting with a guided lateral movement of said first piece lower coupling projection into said opening and away from said catch receiving surface, with a subsequent downward movement of said first piece lower coupling projection into said laterally expanded lower hole portion and with a following subsequent guided lateral movement of said first piece lower coupling projection toward said catch receiving surface to bring said first piece friction engagement surface into contact with said catch receiving surface to provide frictional locking against torsional and lateral forces and for removal of said first coupling piece from said lower container first corner fitting by guiding said first coupling piece away from said catch receiving surface upon pulling said upper container upwardly;

a second coupling piece with a second piece stop plate and a second piece upper container coupling projection on an upper side of said second piece stop plate for placement in said upper container second corner fitting and with a second piece lower coupling projection on a lower side of said second piece stop plate for placement in said lower container second corner fitting, said second piece lower coupling projection comprising a second piece non-positive locking means including a second piece locking catch extending laterally with respect to a longitudinal direction of the containers and having a second piece friction engagement surface for engaging said catch receiving surface inside said lower container second corner fitting, said second piece non-positive locking means for guiding said second coupling piece during insertion into said lower container second corner fitting with a guided lateral movement of said second piece lower coupling projection into said opening and away from said catch receiving surface, with a subsequent downward movement of said second piece lower coupling projection into said laterally expanded lower hole portion and with a following subsequent guided lateral movement of said second piece lower coupling projection toward said catch receiving surface to bring said second piece friction engagement surface into contact with said catch receiving surface to provide frictional locking against torsional and lateral forces and for removal of said second coupling piece from said lower container second corner fitting by guiding said second coupling piece away from said catch receiving surface upon pulling said upper container upwardly;

a third coupling piece with a third piece stop plate and a third piece upper container coupling projection on an upper side of said third piece stop plate for placement in said upper container third corner fitting and with a third piece lower coupling projection on a lower side of said third piece stop plate for placement in said lower container third corner fitting, said third piece lower coupling projection comprising a third piece non-positive locking means including a third piece locking catch extending laterally with respect to a longitudinal direction of the containers and having a third piece friction engagement surface for engaging said catch receiving surface inside said lower container third corner fitting, said third piece non-positive locking means for guiding said third coupling piece during insertion into said lower container third corner fitting with a guided lateral movement of said third piece lower coupling projection into said opening and away from said catch receiving surface, with a subsequent downward movement of said third piece lower coupling projection into said laterally expanded lower hole portion and with a following subsequent guided lateral movement of said third piece lower coupling projection toward said catch receiving surface to bring said third piece friction engagement surface into contact with said catch receiving surface to provide frictional locking against torsional and lateral forces and for removal of said third coupling piece from said lower container third corner fitting by guiding said third coupling piece away from said catch receiving surface upon pulling said upper container upwardly; and a fourth coupling piece with a fourth piece stop plate and a fourth piece upper container coupling projection on an upper side of said fourth piece stop plate for placement in said upper container fourth corner fitting and with a fourth piece lower coupling projection on a lower side of said fourth piece stop plate for placement in said lower container fourth corner fitting, said fourth piece lower coupling projection comprising a fourth piece non-positive locking means including a fourth piece locking catch extending laterally with respect to a longitudinal direction of the containers and having a fourth piece friction engagement surface for engaging said catch receiving surface inside said lower container fourth corner fitting, said fourth piece non-positive locking means for guiding said fourth coupling piece during insertion into said lower container fourth corner fitting with a guided lateral movement of said fourth piece lower coupling projection into said opening and away from said catch receiving surface, with a subsequent downward movement of said fourth piece lower coupling projection into said laterally expanded lower hole portion and with a following subsequent guided lateral movement of said fourth piece lower coupling projection toward said catch receiving surface to bring said fourth piece friction engagement surface into contact with said catch receiving surface to provide frictional locking against torsional and lateral forces and for removal of said fourth coupling piece from said lower container fourth corner fitting by guiding said fourth coupling piece away from said catch receiving surface upon pulling said upper container upwardly.

8. An arrangement of containers in accordance with claim 7, wherein each said non-positive locking means includes a catch surface of said locking catch with a sloping shoulder defining said friction engagement surface and with a forward end with a lead-in taper to impart said first guided lateral movement during insertion and with said lower coupling projection having a lead-in chamfer adjacent to said stop plate and extending laterally with respect to the longitudinal direction of the containers in a direction opposite to said locking catch to impart said following subsequent guided lateral movement of said lower coupling projection toward said catch receiving surface during insertion and said sloping shoulder guiding said coupling piece away from said catch receiving surface upon applying upward force on said coupling piece.

9. An arrangement of containers in accordance with claim 8, wherein said lower container first corner fitting and said lower container second corner fitting are adjacent to a first end of said lower container and said lower container third corner fitting and said lower container fourth corner fitting are adjacent to an opposite second end of said lower container and said first piece locking catch extends laterally in a first lateral direction, said second piece locking catch extends laterally in said first lateral direction, said third piece locking catch extends laterally in a second lateral direction and said fourth piece locking catch extends laterally in said second lateral direction wherein said first lateral direction is opposite to said first lateral direction.

* * * * *